United States Patent [19]

Diederich

[11] 4,180,413

[45] Dec. 25, 1979

[54] ICE HOCKEY STICK

[75] Inventor: David A. Diederich, Chaska, Minn.

[73] Assignee: The Northland Group, Inc., Chaska, Minn.

[21] Appl. No.: 914,427

[22] Filed: Jun. 12, 1978

Related U.S. Application Data

[62] Division of Ser. No. 742,017, Nov. 15, 1976, Pat. No. 4,134,587.

[51] Int. Cl.[2] ..... B65H 81/00

[52] U.S. Cl. ..... 156/185; 156/190

[58] Field of Search ..... 156/185, 190–192; 273/67 W, 67 A, 67 D, 73 F, DIG. 7, 23

[56] References Cited

U.S. PATENT DOCUMENTS

| | | | |
|---|---|---|---|
| 3,313,541 | 4/1967 | Benkoczy et al. | 273/DIG. 7 |
| 3,691,000 | 9/1972 | Kalnin | 273/DIG. 7 |
| 3,813,098 | 5/1974 | Fisher et al. | 273/67 A X |
| 3,982,760 | 9/1976 | Tiltola | 273/67 A |
| 3,993,308 | 11/1976 | Jenks | 273/73 F |
| 4,052,499 | 10/1977 | Goupil et al. | 273/67 A X |

FOREIGN PATENT DOCUMENTS

| | | | |
|---|---|---|---|
| 591454 | 1/1960 | Canada | 273/67 A |
| 925530 | 5/1973 | Canada | 273/67 A |
| 933965 | 9/1973 | Canada | 273/54 |
| 2353843 | 10/1974 | Fed. Rep. of Germany | 273/67 A |
| 42515 | 4/1970 | Finland | 273/67 D |
| 60203 | 11/1947 | Netherlands | 273/67 A |
| 90729 | 1/1958 | Norway | 273/67 A |
| 618310 | 2/1949 | United Kingdom | 273/67 A |
| 744778 | 2/1956 | United Kingdom | 273/67 D- |

*Primary Examiner*—David A. Simmons

*Attorney, Agent, or Firm*—Burd, Braddock & Bartz

[57] ABSTRACT

An ice hockey stick having an elongated handle attached to a blade. The handle has a solid lightweight and flexible wood body reinforced with plastic sheet members provided with longitudinally oriented glass fibers. The blade has a rocker shaped bottom with a heel carrying an epoxy wear strip. The blade is reinforced with glass fiber fabric impregnated with a resin plastic.

14 Claims, 9 Drawing Figures

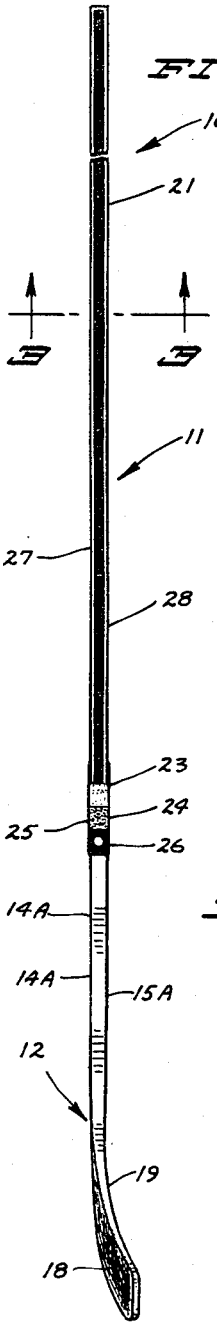
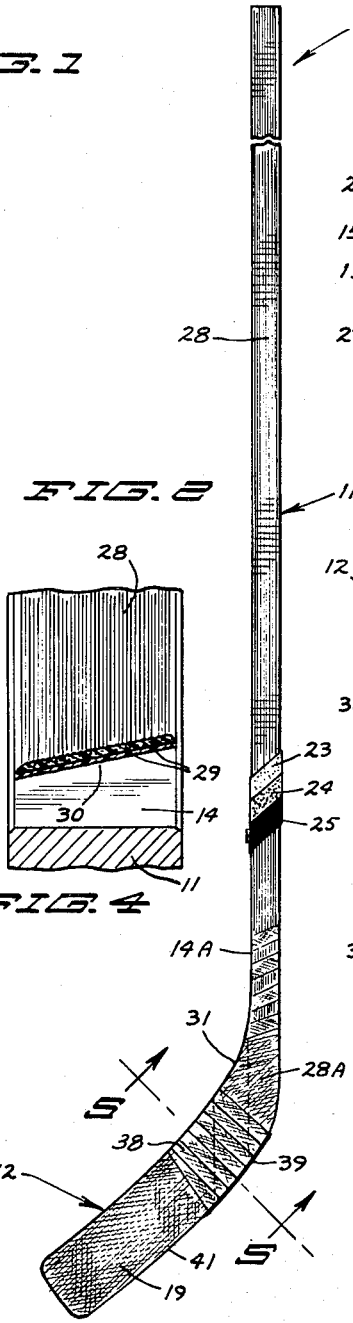
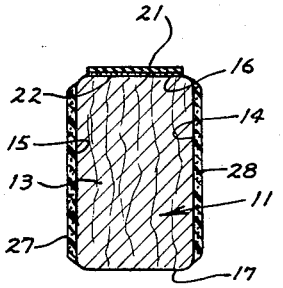
FIG. 3
FIG. 2
FIG. 4
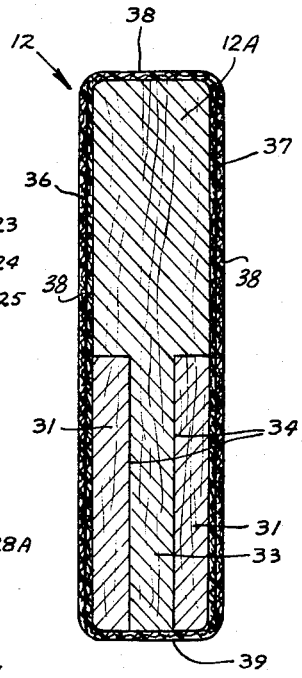
FIG. 5

ICE HOCKEY STICK

This is a division, of application Ser. No. 742,017 filed Nov. 15, 1976, now U.S. Pat. No. 4,134,587.

BACKGROUND OF THE INVENTION

White northern ash is used to make lightweight ice hockey sticks. This wood is resistent to impact breakage and is sufficiently flexible and light. The weight of raw white northern ash used to make the stick varies. The supply of white northern ash is limited, resulting in an inadequate supply of ash stick handles having a finished weight of under 20 oz. It has also been found that the heel portion of the rocker shaped bottom edge of the blade of the hockey stick is the first part of the stick to deteriorate and show signs of wear in use.

Hockey sticks are disclosed in the following patents:

| | | |
|---|---|---|
| U.S. Pat. No. 1,821,889 | Glahe | Sept. 1, 1931 |
| U.S. Pat. No. 2,023,728 | Evernden | Dec. 10, 1935 |
| U.S. Pat. No. 2,040,132 | Hall | May 12, 1936 |
| U.S. Pat. No. 2,260,218 | Evernden | Oct. 21, 1941 |
| U.S. Pat. No. 2,334,860 | Berger | Nov. 23, 1943 |
| U.S. Pat. No. 2,504,242 | Yerger | Apr. 18, 1950 |
| U.S. Pat. No. 2,569,395 | Zupanick | Sept. 25, 1951 |
| U.S. Pat. No. 2,730,367 | Bublik | Jan. 10, 1956 |
| U.S. Pat. No. 3,353,826 | Traverse | Nov. 21, 1967 |
| U.S. Pat. No. 3,458,194 | Coles | July 29, 1969 |
| U.S. Pat. No. 3,489,412 | Franck et al. | Jan. 13, 1970 |
| U.S. Pat. No. 3,533,623 | Dumont | Oct. 13, 1970 |
| U.S. Pat. No. 3,677,542 | Michaud | July 18, 1972 |
| U.S. Pat. No. 3,961,790 | Milligan | June 8, 1976 |
| Canadian Patent No. 459,578 | Boulanger | Sept. 13, 1949 |
| Canadian Patent No. 463,938 | Berger | Mar. 28, 1950 |
| Canadian Patent No. 591,454 | Veillet | Jan. 26, 1960 |
| Canadian Patent No. 896,690 | Peillex | Mar. 28, 1972 |
| Canadian Patent No. 906,020 | Michaud | July 25, 1972 |
| Canadian Patent No. 925,530 | Schumph | May 1, 1973 |
| Norweigan Patent No. 90,729 | Skifabrikk | Nov. 9, 1957 |

SUMMARY OF THE INVENTION:

The invention is directed to a stick known as an ice hockey stick having an elongated linear handle attached to a laterally projected blade. The handle comprises an elongated linear body having a generally rectangular cross section and opposite linear outside surfaces. Reinforcing sheet members are secured with an adhesive to the opposite outside surfaces of the body. Each sheet member has a plurality of reinforcing fibers, as glass fibers, oriented along the longitudinal length of the sheet members. The glass fibers are impregnated in a rigid plastic resin. The sheet members are pultruded glass fiber members. The body can be made of numerous lightweight and flexible woods including but not limited to ash, aspen, basswood, sitka spruce and poplar. The reinforcing sheet members resist the breakage of the wood body and provide for a stick handle that is consistent in weight and has memory flexibility. Lightweight woods, as basswood, sitka spruce and poplar, heretofore not usable for hockey sticks because of their low strength and flexibility, can now be used with the reinforcing side sheet members.

The lower end of the handle has a longitudinal midgroove accommodating a flat tongue portion of the blade. Bonding means secure the tongue portion of the blade and handle together. A first reinforcing fabric is located along adjacent sides of the blade and attached thereto with a plastic resin. A second reinforcing fabric is wrapped around the blade and lower end of the handle. An elongated plastic wear strip, as epoxy, extends along the heel of the lower rocker edge of the blade. The reinforcing sheet members on opposite sides of the handle extend downwardly to the plastic wear strip.

An object of the invention is to provide a hockey stick handle with reinforcing side sheet members bonded to opposite sides of a lightweight and flexible wood body secured to a blade having a wear strip located along the heel of the blade. A further object of the invention is to provide a hockey stick with a lightweight handle that can be made from numerous types of wood reinforced with sheet members having longitudinally oriented glass fibers impregnated in a plastic resin bonded to opposite sides of the handle in conjunction with a blade reinforced with reinforcing fabric impregnated in a plastic resin. A further object of the invention is to provide a light-weight hockey stick that has an attained weight of less than 20 oz., and is flexible, durable and sturdy in use. Yet another object of the invention is to provide an improved method of making a lightweight and flexible hockey stick.

IN THE DRAWINGS

FIG. 1 is a front elevational view of an ice hockey stick embodying the features of the invention;

FIG. 2 is a side elevational view of FIG. 1;

FIG. 3 is an enlarged sectional view taken along the line 3—3 of FIG. 1;

FIG. 4 is an enlarged fragmentary perspective view of a side of the handle of the hockey stick of FIG. 2;

FIG. 5 is an enlarged sectional view taken along the line 5—5 of FIG. 2;

DESCRIPTION OF PREFERRED EMBODIMENT OF INVENTION

Figure 6:
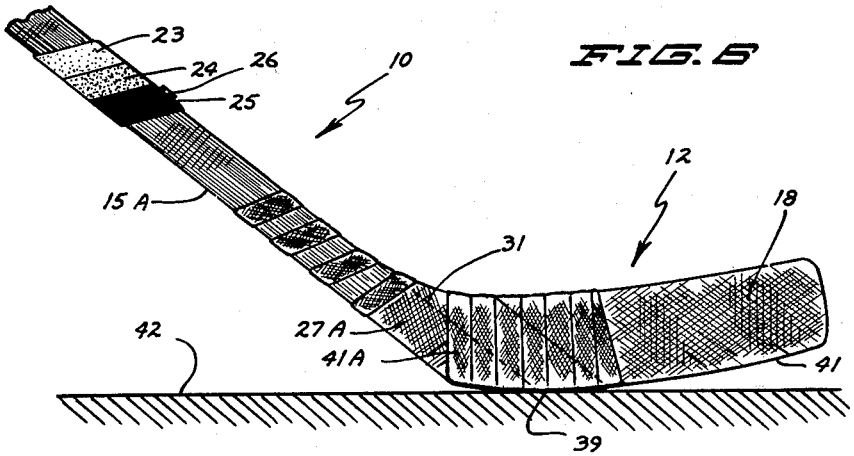
FIG. 6 is an enlarged side elevational view of the lower or blade end of the ice hockey stick of FIG. 1.

Referring to FIGS. 1 and 2, there is shown an ice hockey stick, indicated generally at 10, having an elongated longitudinal linear handle 11 attached at its lower end to a curved blade 12. The curvature of blade 12 can be left or right, and the amount of curvature or hook can vary. Blade 12 can be straight or neutral by being located in the longitudinal plane of handle 11. The regulation limits of the curvature of the blades are disclosed in U.S. Pat. No. 3,902,250.

Handle 11 has a wood body 13. The grain of the wood of body 13 extends along the longitudinal length of the body. The body 13 shown in FIG. 3 is a solid wood. The wood can be hickory, ash, pine, basswood, sitka spruce, aspen or poplar. Other types of woods can be used for the body of the handle. The wood is flexible and light in weight. The specified species will result in a finished stick with a weight of 20 or less ounces.

Body 13 has a rectangular cross section with flat linear opposite outside surfaces 14 and 15, a flat linear front outside surface 16, and a flat back outside surface 17. Surfaces 14, 15, 16 and 17 extend the full length of handle 11. The lower end of handle 11 has downwardly and inwardly converging sides 14A and 15A joined with and coextensive with opposite sides 18 and 19 of blade 12.

An ornamental elongated strip or ribbon 21 is attached with adhesive 22 to the front surface 16. Strip 21 has a width slightly less than the width of surface 16. As shown in FIG. 1, opposite linear line portions of surface 16 project laterally from opposite sides of strip 21. Strip 21 is shown in FIG. 1 as a solid black surface. An example of this surface is a plastic solid black tape secured with adhesive to the body surface 16. Tapes of other colors, as red, blue, yellow and green and the like, can be used in association with handle 11. Strip 21 can be paint, a plastic skin, a burned surface or like colored indicia on the front surface 16 of handle 11.

Three side-by-side bands, bars or chevrons 23, 24 and 25 of contrasting colors surround the lower end of handle 11 at the end portion of strip 21. The bands 23, 24 and 25 are angularly inclined upwardly from the front surface 16 to back surface 17 and are generally parallel to the longitudinal or length dimension of the top of blade 12. Each band 23, 24 and 25 has a width that is wider than the width of strip 21. Returning to FIG. 1, a small circle or colored dot 26 is located on the front of band 25. Dot 26 has a color, as red, that contrasts with the colors of band 25.

An example of the contrasting colors of bands 23, 24 and 25 is as follows: band 23 is a grey tape; band 24 is a silver tape; and band 25 is a black tape. Each band surrounds the handle and is secured to the surfaces 14, 15, 16 and 17 with an adhesive. Other colored bands, including black, white and black; red, white and red; and red, white and blue, can be used for bands 23, 24 and 25. Bands 23, 24 and 25 can be paint, plastic skin, burned surfaces and like colored indicia. Hockey sticks having a front strip or angled or inclined bars are disclosed in co-pending U.S. Design application Ser. No. 623,465 filed Oct. 17, 1975, now U.S. Pat. No. Des. 244,220 and Canadian industrial Design No. 41148.

Referring to FIGS. 3 and 4, wood body 13 of handle 11 is reinforced with side sheet members 27 and 28. Sheet members 27 and 28 have longitudinally oriented linear fibers 29 embedded within a plastic resin. Fibers 29 are longitudinal linear glass fibers embedded within a rigid elastic plastic resin material. Layers of adhesive 30 secure the entire inside surface of the sheet member 27 to side 13 and the entire inside surface of sheet member 28 to side 14. Sheet members 27 and 28 are pultruded plastic having glass fibers. The glass fibers are all longitudinally oriented along the length of the sheet members. The glass fibers can be glass material or materials compounded with graphite. The fibers are embedded in a yieldable plastic base or matrix. The side sheet members 27 and 28 increase the memory of handle 11 without breaking the handle. In other words, handle 11 will return to its original shape or straight plane after being subjected to a bending force, as a hard slap shot. This increases the accuracy of the shot and the speed of the puck. Other types of linear fibers, as polyester and nylon fibers, can be used to reinforce the sheet members 27 and 28. Also, high modulus fibers, as carbon, graphite, boron, and polyamide can be incorporated in the resin base of sheet members 27 and 28.

Figure 7:
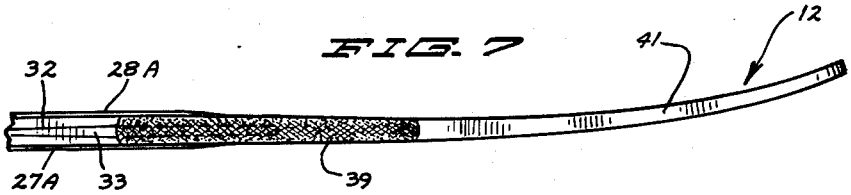
FIG. 7 is an enlarged bottom plan view of FIG. 6.
Figure 8:
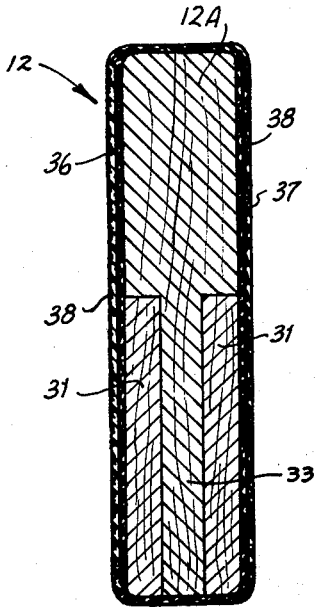
FIG. 8 is a sectional view similar to FIG. 5 showing the blade wrapped with two layers of glass fiber material impregnated with a plastic resin.
Figure 9:
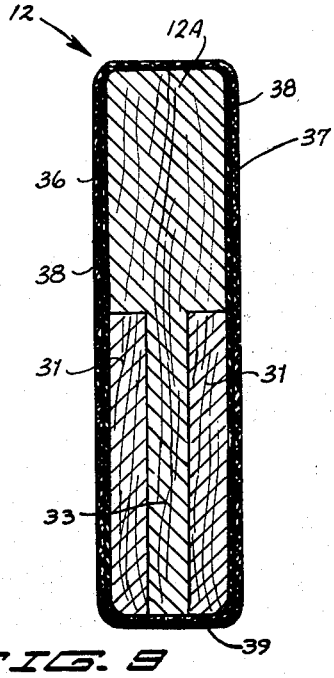
FIG. 9 is a sectional view similar to FIG. 8 showing an epoxy wear strip impregnated in the glass fiber material along the heel of the blade.

A rigid joint structure connects the lower end of handle 11 to the inner end of blade 12. The joint structure includes a glue block 31 secured with a bonding material or glue or the like to the front side of the lower end of the handle 11. Glue block 31 and the lower end of handle 11 has a V-shaped groove 32 along a longitudinal axis of the block and handle. The groove 32 is shown in FIG. 7. Blade 12 has a complementary V-shaped tongue or rib 33 located within groove 32. Bonding material 34 secures the adjacent surfaces of tongue, glue block and lower end of handle 11 together to form a rigid joint structure.

Blade 12 has a wood core or body 12A that is reinforced with a first sheet of glass fabric 36 located on side 18 and a second sheet of glass fabric 37 located adjacent the side 19 of blade 12. A ribbon or wrapping of glass fabric 38 is located around the inner portion of blade 12 and extends upwardly around the lower end of handle 11. The fabric 36, 37 and 38 is a woven glass fiber fabric. A plastic thermosetting resin such as polyester is impregnated in the fabric and bonds the fabric to the opposite sides of the blade 12 and the lower end of handle 11 and the sheet members 27 and 28. The fabric and plastic resin is pressed in firm contact with the sides of the blade 12.

As shown in FIGS. 6 and 7, an elongated wear strip 39 is located along the lower edge of rear or heel portion 41A of the bottom of blade 12. Blade 12 has a rocker or convex shaped bottom edge 41 that engages the ice 42 along the heel portion 41A. Wear strip 39 is a bead of plastic material such as a tough epoxy plastic impregnated into the lower edge of the ribbon of fabric 38 and bonded to the lower edge of heel portion 41A of blade 12. Wear strip 39 functions as a shock and wear absorbing bead as it rides on the surface of ice 42 and it takes the abuse of the movement and pounding of the stick on the ice. Strip 39 also absorbs impact forces subjected to the heel portion of the stick when the player takes a slap shot. Wear strip 39 minimizes the shattering and breaking of the stick in the area of the heel, thereby adding to the durability and longevity of the stick. An example of the epoxy resin material is bisphenol-A epichlorohydrin resin. Other types of epoxy resins can be used. The epoxy resin has a high degree of solvent resistance, adhesion to wood and fiber substrates, and good impact resistance and flexibility.

Hockey stick 10 is manufactured from the raw wood product comprising an elongated handle body, a glue block and a flat wood blade. The body and block are glued together. Groove 32 is placed in the lower end of the body and block with a rotating circular cutting tool. One end of blade 12 is cut to form the tongue portion 33. The blade 12 is secured to the handle and block by placing tongue portion 33 in groove 32 and securing or bonding these parts together with glue or suitable bonding material A circular cutting tool is used to shape the blade and the lower end of the handle to outline shape. The handle and blade is then sanded to the finished shape.

The elongated sheet members 27 and 28 are secured with the adhesive 30 to the opposite sides of the handle. The sheet members 27 and 28 have lower sections 27A and 28A that extend all the way down to the lower edge of the heel of blade 12.

Fabric sheets 36 and 37 are placed adjacent opposite sides of the blade over the lower ends of the sheet members 27 and 28 and extend a short distance up the handle 11. A plastic resin is then applied to fabric sheets 36 and 37. Ribbon 38 is a tape of glass fiber fabric that is wrapped around the rear portion of the blade and over the heel section 41A. The plastic resin being uncured and in a semi-liquid state is absorbed by the fabric sheets 36 and 37 and the ribbon of fabric 38. The plastic resin is not placed on the heel section of the blade. The ribbon 38 of fabric extended along the heel section 41 is embedded in the epoxy strip 39. Epoxy material is applied onto the heel to make the strip 39. Strip 39 extends approximately one-half the distance of the bottom rocker edge 41 of blade 12.

The ornamental black strip 21 is applied to the front surface 16 of handle 11. The angled triad of bars 23, 24 and 25 are then secured to the handle adjacent the lower end of strip 21. Additional designs and trademarks are applied to the handle before the stick is packaged for shipment to the consumer.

While there has been shown and described a preferred embodiment of an ice hockey stick and method of making the ice hockey stick, it is understood that changes in the structure and materials of the ice hockey stick and the method of making the ice hockey stick can be made by those skilled in the art without departing from the invention. The invention is defined in the following claims.

The embodiments of the invetion in which an exclusive property or privilege is claimed are defined as follows:

1. A method of making an ice hockey stick having a handle including a body and sheet members and blade having opposite sides, a lower edge and a heel portion comprising: attaching the blade to the handle, shaping the blade and handle, attaching elongated sheet members having elongated fibers with all of the fibers oriented along the length of the sheet members to opposite sides of the body, attaching a first reinforcing fabric with plastic resin to opposite sides of the blade, wrapping a second reinforcing fabric around the first reinforcing fabric, the blade, and at least the lower edge of the heel portion of the blade, said plastic resin bonding the sides of the second fabric to the first fabric, and applying a wear strip to the second fabric adjacent the lower edge of the heel portion of the blade and the lower edge of the heel portion of the blade.

2. The method of claim 1 wherein: the sheet members are attached to the sides of the body by adhesively bonding the entire inside surfaces of the sheet members to the sides of the body.

3. The method of claim 1 wherein: the first reinforcing fabric covers and is attached to lower portions of the sheet members.

4. The method of claim 14 wherein: the first and second reinforcing fabric covers and is attached to lower portions of the sheet members.

5. The method of claim 14 wherein: the wear resistant strip is applied to the blade by embedding a plastic material in a part of the second fabric and securing the plastic material to the lower edge of the heel portion of the blade.

6. A method of making an ice hockey stick having a handle including a body with opposite sides and sheet members, and a blade, said blade having opposite sides, and a heel portion having a lower edge comprising: attaching the blade to the body of the handle, shaping the blade and handle, attaching elongated sheet members having elongated fibers with all of said fiber being oriented along the length of the sheet members to opposite sides of the body, locating reinforcing fabric adjacent opposite sides of the blade, adjacent lower portions of the sheet members, and along the lower edge of the heel portion of the blade, applying plastic resin to opposite sides of the blade to secure the fabric to the opposite sides of the blade and lower portions of the sides of the sheet members, said fabric adjacent the lower edge of the heel portion of the blade being substantially devoid of resin, and applying a wear resistant strip to the fabric adjacent the lower edge of the heel portion of the blade and the lower edge of the heel portion of the blade.

7. The method of claim 6 wherein: the sheet members are attached to the sides of the body by adhesively bonding the entire inside surfaces of the sheet members to the sides of the body.

8. The method of claim 6 wherein: the wear resistant strip is a plastic material embedded in the fabric located adjacent the lower edge of the heel portion of the blade and bonded to the lower edge of the blade.

9. The method of claim 6 wherein: the lower resistant strip includes an epoxy plastic embedded in the fabric located adjacent the lower edge of the heel portion of the blade, said epoxy plastic being bonded to the lower edge of the heel portion of the blade.

10. The method of claim 1 wherein: the wear resistant strip is an epoxy plastic embedded in the second fabric located adjacent the lower edge of the heel portion of the blade, said epoxy plastic being bonded to the lower edge of the heel portion of the blade.

11. A method of making an ice hockey stick having a handle and a blade attached to the handle, said blade having opposite sides and a heel portion having a lower edge comprising: attaching the blade to an end of the handle; shaping the blade and handle; locating reinforcing fabric adjacent opposite sides of the blade and along the lower edge of the heel portion, applying plastic resin to opposite sides of the blade and fabric to secure the fabric to the opposite sides of the blade, said fabric adjacent the lower edge of the heel portion being substantially devoid of resin, and applying a wear resistant strip to the fabric adjacent the lower edge of the heel portion of the blade and the lower edge of the heel portion of the blade.

12. The method of claim 10 wherein: the wear resistant strip is a plastic material embedded in the fabric located adjacent the lower edge of the heel portion of the blade and bonded to the lower edge of the blade.

13. The method of claim 11 wherein: the wear resistant strip includes an epoxy plastic embedded in the fabric located adjacent the lower edge of the heel portion of the blade, said epoxy plastic being bonded to the lower edge of the heel portion of the blade.

14. The method of claim 11 wherein: the reinforcing fabric includes a first fabric positioned adjacent the opposite sides of the blade and a second fabric secured around the blade and over the lower edge of the heel portion of the blade, said plastic resin securing the first and second fabrics to the opposite sides of the blade

* * * * *

UNITED STATES PATENT AND TRADEMARK OFFICE

CERTIFICATE OF CORRECTION

PATENT NO. : 4,180,413

DATED : December 25, 1979

INVENTOR(S) : David A. Diederich

It is certified that error appears in the above-identified patent and that said Letters Patent are hereby corrected as shown below:

Column 5, line 20, "invetion" should be -- invention --.

Column 5, line 46, "14" should be -- 1 --.

Column 5, line 49, "14" should be -- 1 --.

Column 6, line 21, "lower" should be -- wear --.

Signed and Sealed this

*Fifteenth* Day of *April 1980*

[SEAL]

*Attest:*

SIDNEY A. DIAMOND

*Attesting Officer*

*Commissioner of Patents and Trademarks*